US005377159A

United States Patent [19]

Endo

[11] Patent Number: 5,377,159

[45] Date of Patent: Dec. 27, 1994

[54] IMPROVED METHOD AND CIRCUIT FOR HISTORICAL CONTROL OF THERMAL PRINTING

[75] Inventor: Takafumi Endo, Amagasaki, Japan

[73] Assignee: Mitsubishi Denki Kabushiki Kaisha, Tokyo, Japan

[21] Appl. No.: 856,757

[22] Filed: Mar. 24, 1992

[30] Foreign Application Priority Data

Mar. 25, 1991 [JP] Japan ..... 3-082936
Sep. 17, 1991 [JP] Japan ..... 3-262587
Jan. 20, 1992 [JP] Japan ..... 4-027480

[51] Int. Cl.[5] ..... B61J 2/375; B61J 2/365; B61J 2/37

[52] U.S. Cl. ..... 366/76 PH

[58] Field of Search ..... 346/76 PH; 400/120

[56] References Cited

U.S. PATENT DOCUMENTS 3,975,707 8/1976 Ito et al. ..... 346/76PH
4,305,080 12/1981 Cunningham et al. ..... 346/76 PH

FOREIGN PATENT DOCUMENTS 00102375 10/1982 Japan .
00247065 1/1989 Japan .

*Primary Examiner*—Benjamin R. Fuller
*Assistant Examiner*—Huan Tran
*Attorney, Agent, or Firm*—Rothwell, Figg, Ernst & Kurz

[57] ABSTRACT

A historical control circuit in a thermal printer controls the drive current fed to a resistive heating clement according to the printing of previous dots by that resistive heating clement. The circuit remembers whether or not the heating element printed a certain number of preceding dots and, for each printed dot among those dots, masks an interval in the drive signal. This is done in such a way that if two patterns of previous dots contain unequal numbers of printed dots but generate equal residual temperatures, the drive signal for the pattern with more printed dots is divided into more separate pulses. Adjustments can be made by masking or unmasking a specific interval for a specific pattern. Cutoff of the drive signal may be delayed for patterns in which a certain number of most recent dots were all unprinted.

13 Claims, 22 Drawing Sheets

FIG. 4

| | PATTERN | POINTS |
|---|---|---|
| | Q3 Q2 Q1 | |
| LEVEL 1 | L L H | 1.0 |
| LEVEL 2 | H L H | 1.5 |
| | L H H | 2.0 |
| LEVEL 3 | H H H | 3.0 |

FIG. 13

| | PATTERN | | | | POINTS |
|---|---|---|---|---|---|
| | Q4 | Q3 | Q2 | Q1 | |
| LEVEL 1 | L | L | L | H | 1.0 |
| LEVEL 2 | H | L | L | H | 1.0 |
| | L | H | L | H | 1.5 |
| | L | L | H | H | 2.0 |
| LEVEL 3 | H | H | L | H | 2.5 |
| | H | L | H | H | 2.5 |
| | L | H | H | H | 3.0 |
| LEVEL 4 | H | H | H | H | 4.0 |

FIG. 16

| | PATTERN | | | | | POINTS |
|---|---|---|---|---|---|---|
| | Q5 | Q4 | Q3 | Q2 | Q1 | |
| LEVEL 1 | L | L | L | L | H | 1.0 |
| LEVEL 2 | H | L | L | L | H | 1.0 |
| | L | H | L | L | H | 1.0 |
| | L | L | H | L | H | 1.5 |
| | L | L | L | H | H | 2.0 |
| LEVEL 3 | H | H | L | L | H | 2.0 |
| | H | L | H | L | H | 2.0 |
| | H | L | L | H | H | 2.0 |
| | L | H | H | L | H | 2.5 |
| | L | H | L | H | H | 2.5 |
| | L | L | H | H | H | 3.0 |
| LEVEL 4 | H | H | H | L | H | 3.5 |
| | H | H | L | H | H | 3.5 |
| | H | L | H | H | H | 3.5 |
| | L | H | H | H | H | 4.0 |
| LEVEL 5 | H | H | H | H | H | 5.0 |

IMPROVED METHOD AND CIRCUIT FOR HISTORICAL CONTROL OF THERMAL PRINTING

BACKGROUND OF THE INVENTION

This invention relates to the art of thermal printing, more particularly to an improved method and circuit for performing historical control of printing darkness.

Because of their simple construction, quiet operation, and low cost, thermal printers are widely used as output devices of facsimile machines, word processors, and personal computers. A thermal printer has a number of resistive heating elements equal, for example, to the number of dots across a page in the horizontal direction, or the number of dots per character in the vertical direction. Printing takes place as a page is scrolled past these resistive heating elements, or as the resistive heating elements travel across the page on a movable print head. When a dot is to be printed, current is fed to the corresponding resistive heating element, raising its temperature. The heat thus generated darkens the adjacent portion of the page, if thermosensitive paper is used, or causes transfer of ink from a ribbon to the page in printers using plain paper.

A problem in thermal printing is that when a resistive heating element prints a series off dots, the dots tend to get successively darker because of residual heat. This problem can be overcome by regulating the amount of printing current fed to the resistive heating element according to the printing or non-printing of the last few dots, a technique known as historical control.

A prior-art method of historical control supplies a current pulse of a certain length to print a dot, but masks parts of that pulse for dots printed by the same resistive heating element in the previous two lines. (The "line" may be horizontal or vertical, depending on the configuration of thee printer.) This method improves the appearance of the printed output, but does not achieve completely uniform dots; more refined forms of historical control are necessary. Attempts at refining historical control, however, lave encountered certain problems.

One problem is that the heating curve of a resistive heating clement is not linear, so simplistic schemes of regulating the amount of current according to the number of historical dots printed are unsatisfactory. An ideal solution would be to track the printing history of the resistive heating clement through a large number of past dots and calculate the optimum current to be fed for every historical pattern of dots, but this scheme would encounter a second problem: the necessary control circuitry would be highly complex and require an impractically large number of signal lines.

SUMMARY OF THE INVENTION

It is accordingly an object of the present invention to provide simple but accurate means of historical control.

Another object of the invention is to compensate for nonlinearity in historical control.

According to one aspect of the invention, to print a dot preceded by a certain number of non-printed dots, an historical control circuit feeds a first current pulse. If at least one dot among that certain number of preceding dots was printed, the historical control circuit feeds a second current pulse, shorter than the first current pulse, and masks intervals in the second current pulse for each preceding printed dot.

According to another aspect of the invention, to print a dot the historical control circuit feeds a current pulse of a certain length, but masks intervals of the current pulse corresponding to preceding printed dots. These intervals are arranged so that, among patterns of preceding dots generating equal residual temperatures but having different numbers of printed dots, patterns having more printed dots result in division of the current pulse into more separate pulses.

BRIEF DESCRIPTION OF THE DRAWINGS

FIG. 4 is a chart summarizing the Information in FIG. 3.

FIG. 13 is a chart summarizing the eight three-dot historical heating patterns.

FIG. 16 is a chart summarizing the sixteen four-dot historical heating patterns.

DETAILED DESCRIPTION OF THE INVENTION

Before the invention is described in detail, it will be useful to discuss certain aspects of the theory of thermal printing and illustrate how the theory works in the relevant prior art. Temperature values and other numerical values will be shown, but these values are illustrative and do not restrict the scope of the invention.

Figure 1:
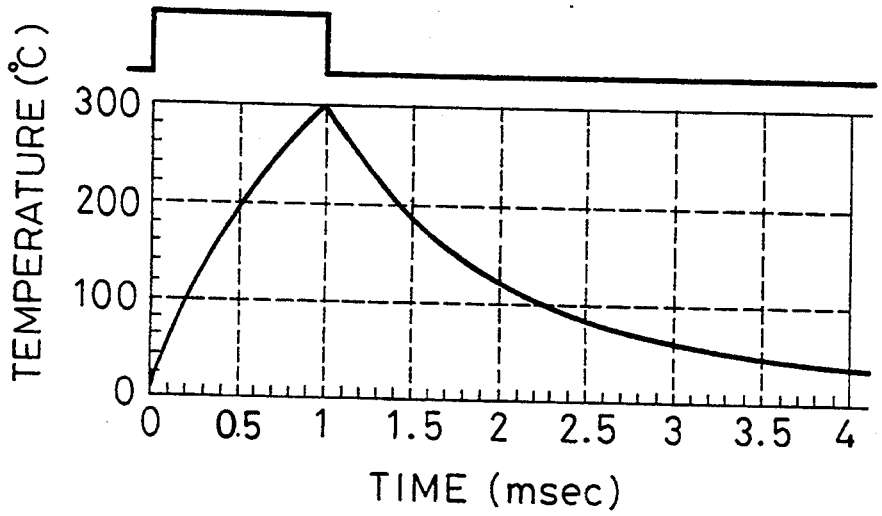
FIG. 1 is a graph of a the heating and cooling curve of resistive heating element.

FIG. 1 illustrates the effect of feeding a onemillisecond current pulse to a resistive heating element, showing temperature on the vertical axis and time on the horizontal axis. During the duration of the pulse the temperature of the resistive heating element rises from 20° C. to 300° C., rising steeply at first and then more gradually. After the current is switched off the resistive heating element cools at an even more gradual rate. The heating and cooling curves are both nonlinear. The heating curve can be described by an equation of the Form:

$$\Delta T = Pd \cdot Rth \cdot \{1 - \exp(-t/)\}$$

where Pd is applied power, Rth is the thermal resistance of the resistive heating element, t is the length of the current pulse, and $\tau$ is a time constant.

Figure 2:
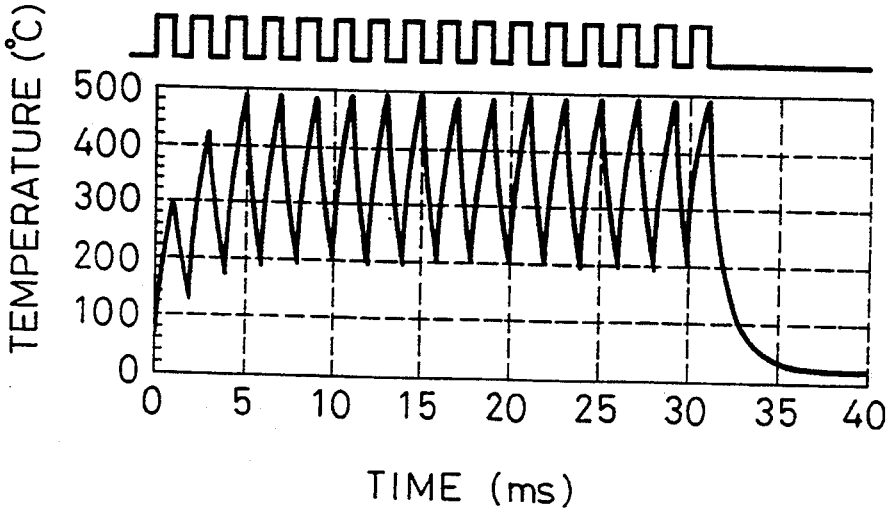
FIG. 2 Is a graph illustrating heating and cooling when consecutive dots are printed.

FIG. 2 shows the effect of successive current pulses. Because the resistive heating element cools more slowly than it heats, each successive pulse takes the resistive heating element from a higher starting temperature to a higher peak temperature until a saturation state is reached at a maximum peak temperature of nearly 500° C.

Figure 3:
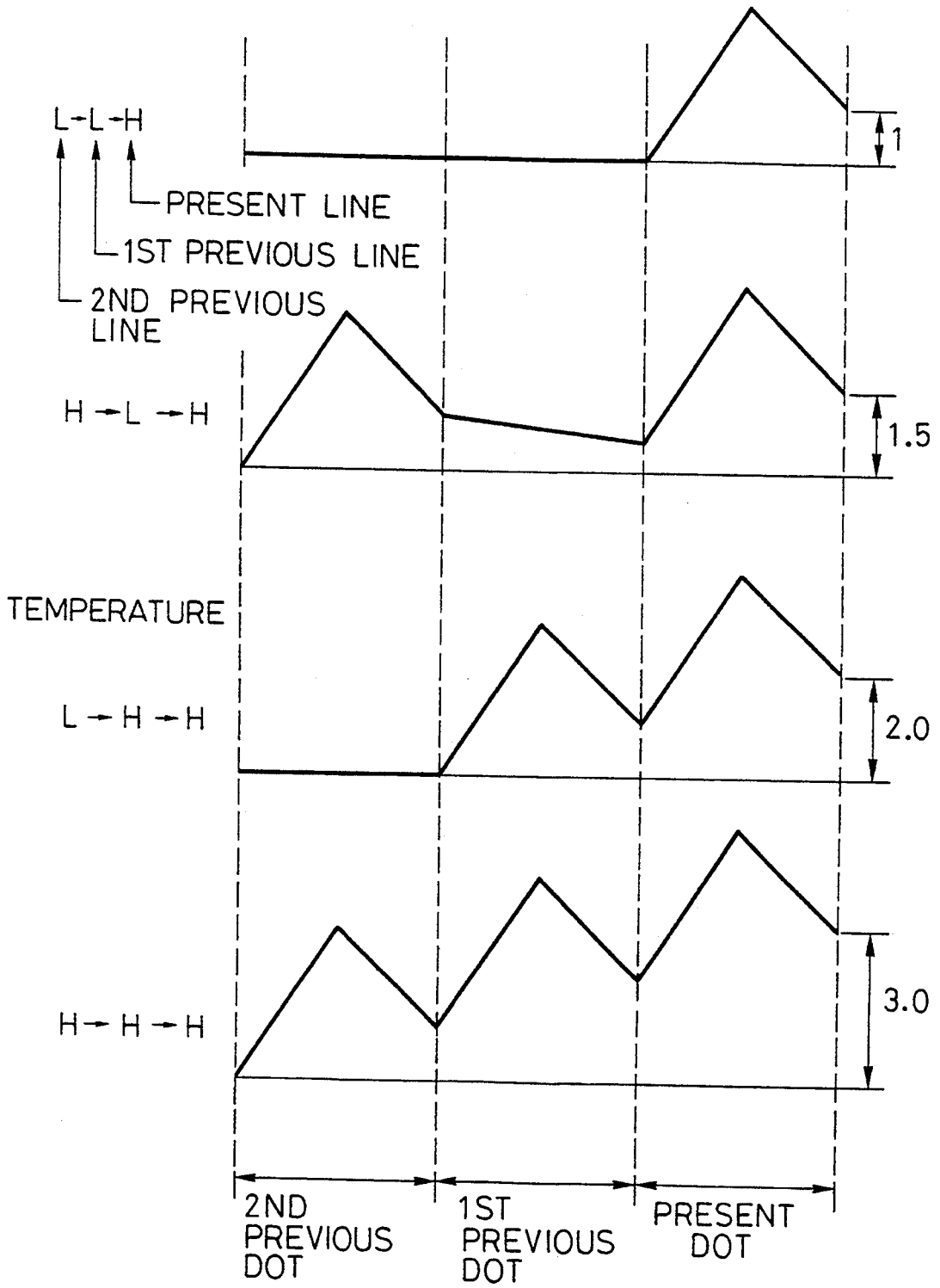
FIG. 3 is a graph illustrating four two-dot historical heating patterns.

FIG. 3 shows a somewhat simplified simulation of the printing of a dot preceded by four different two-dot historical patterns, without historical control. The letter ti (Itigh) is used to represent the feeding of current, i.e. the printing of a dot. The letter L (Low) is used to present non-feeding of current, i.e. non-printing of the dot. Similar notation will be used throughout the description of the invention: H will represent the high or active state: L will represent the low or inactive state.

The L-L-H pattern takes the resistive heating element to a certain maximum temperature, e.g. the temperature 300° C. shown in FIG. 1, and leaves it at a certain residual temperature, represented in FIG. 3 by the value 1 on a normalized point scale. The H-L-H pattern yields higher maximum and residual temperatures, hence a darker dot. The L-H-H pattern yields a still biglief maximum temperature and an even darker dot. The highest temperature and darkest; dot of all are given, of course, by the H-H-H pattern.

FIG. 4 summarizes the Information in FIG. 3 in chart form. The four patterns are listed in the center column; the symbols (Q1, Q2, and Q3 refer to latch outputs described later. The left-hand column indicates the level of each pattern; here the word "level" is used to mean the number of printed dots in the pattern, including the present dot which is printed in all four patterns. The right-hand column lists the point values which represent residual temperature on the normalized scale employed in FIG. 3.

Figure 5:
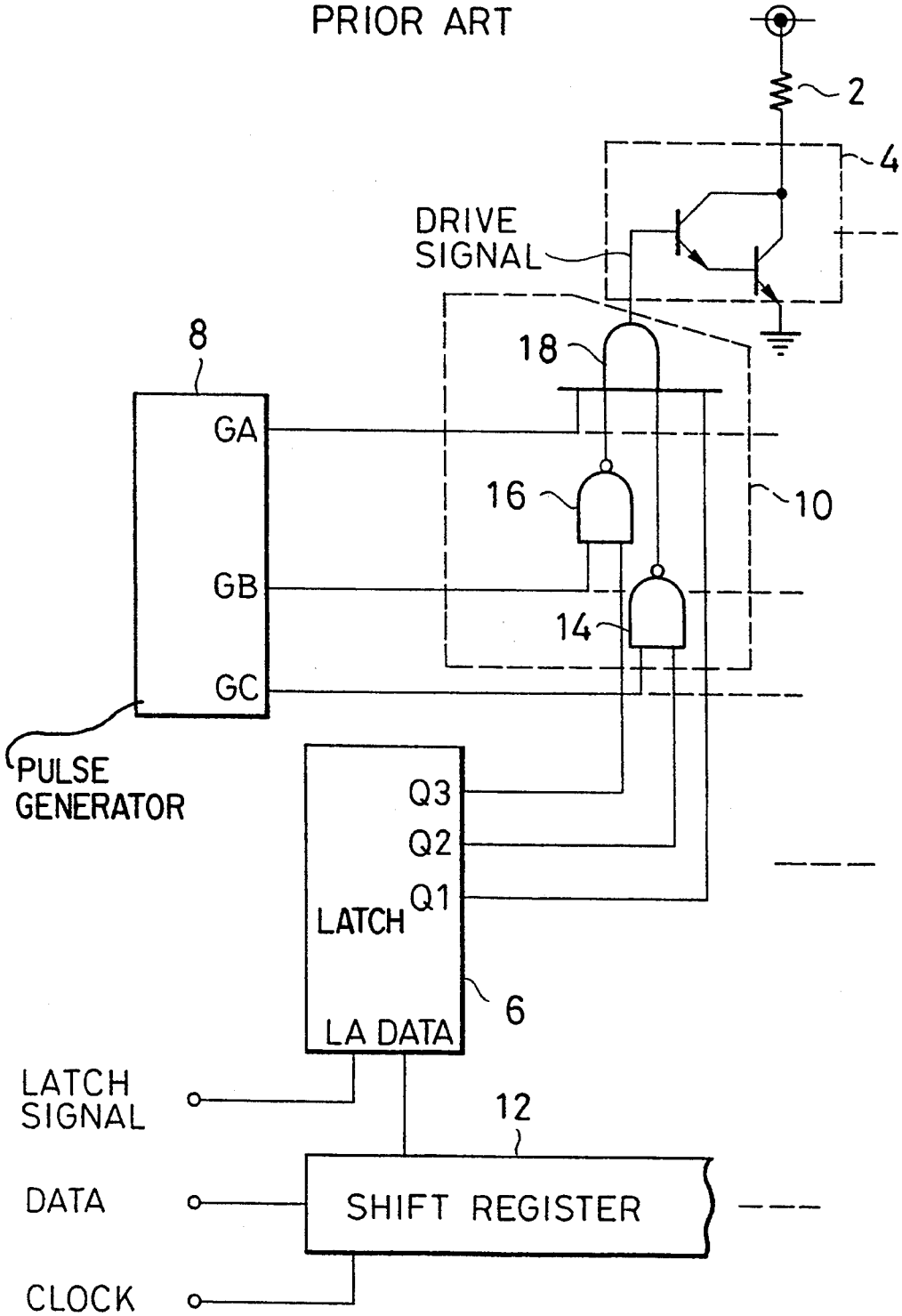
FIG. 5 PRIOR ART
FIG. 5 is a block diagram Illustrating a prior-art historical control circuit.

FIG. 5 shows a prior-art circuit for historical control. The circuit comprises a resistive heating element 2, a driver circuit 4, a latch 6, a pulse generator 8, and a logic circuit 10. Data to be printed are supplied from a shift register 12.

The resistive heating element 2 generates printing heat when fed current from the driver circuit 4. The driver circuit 4, which comprises two transistors connected in a Darlington pair configuration, is activated by a drive signal.

The latch 6 has a data input terminal coupled to shift register 12, a latch input terminal (LA) for receiving a latch signal, and three output terminals Q1, Q2, and Q3. When it receives a latch signal, the latch 6 latches the input at its data terminal and outputs this data value at the Q1 terminal. At the same time, it shifts data stored in well-known internal circuits so that the previous Q1 output becomes the new Q2 output, and the previous Q2 output becomes the new Q3 output. The Q1 output is a dot printing signal indicating whether or not to print the present dot. The Q2 output is an historical dot signal indicating wether or not the immediately preceding dot was printed. The Q3 output is another historical dot signal indicating whether the dot before that was printed.

The pulse generator 8 generates a drive pulse at an output terminal marked CA, and two masking pulses at output terminals marked GB and GC. Pulse generating circuits are well known, so internal structural details of the pulse generator 8 arc omitted.

The logic circuit 10 comprises two NAND gates 14 and 16 and a four-input AND gate 18. The NAND gate 14 gates the masking pulse from the GC terminal of the pulse generator 8 with the historical dot signal from the Q2 terminal of the latch 6: the output of the NAND gate 14 is inactive when GC and Q2 are both active, and active at all other times. The NAND gate 16 similarly gates the GB masking pulse with the Q3 historical dot signal. The AND gate 18 receives as inputs the dot printing signal from the Q1 terminal of the latch 6, the drive pulse from the GA terminal of the pulse generator 8, and the outputs of the NAND gates 14 and 16, and generates the drive signal that activates the driver circuit 4. Tile drive signal is active when all inputs to the AND gate 18 are active, and Inactive at other times.

The shift register 12 receives serial dot data in synchronization with a clock signal, stores the quantity of dot data necessary for printing one line, and outputs this line of dot dater in parallel to a plurality of historical control elements identical to the one illustrated in FIG. 5. These historical control circuits all share the same pulse generator 8.

Figure 6:
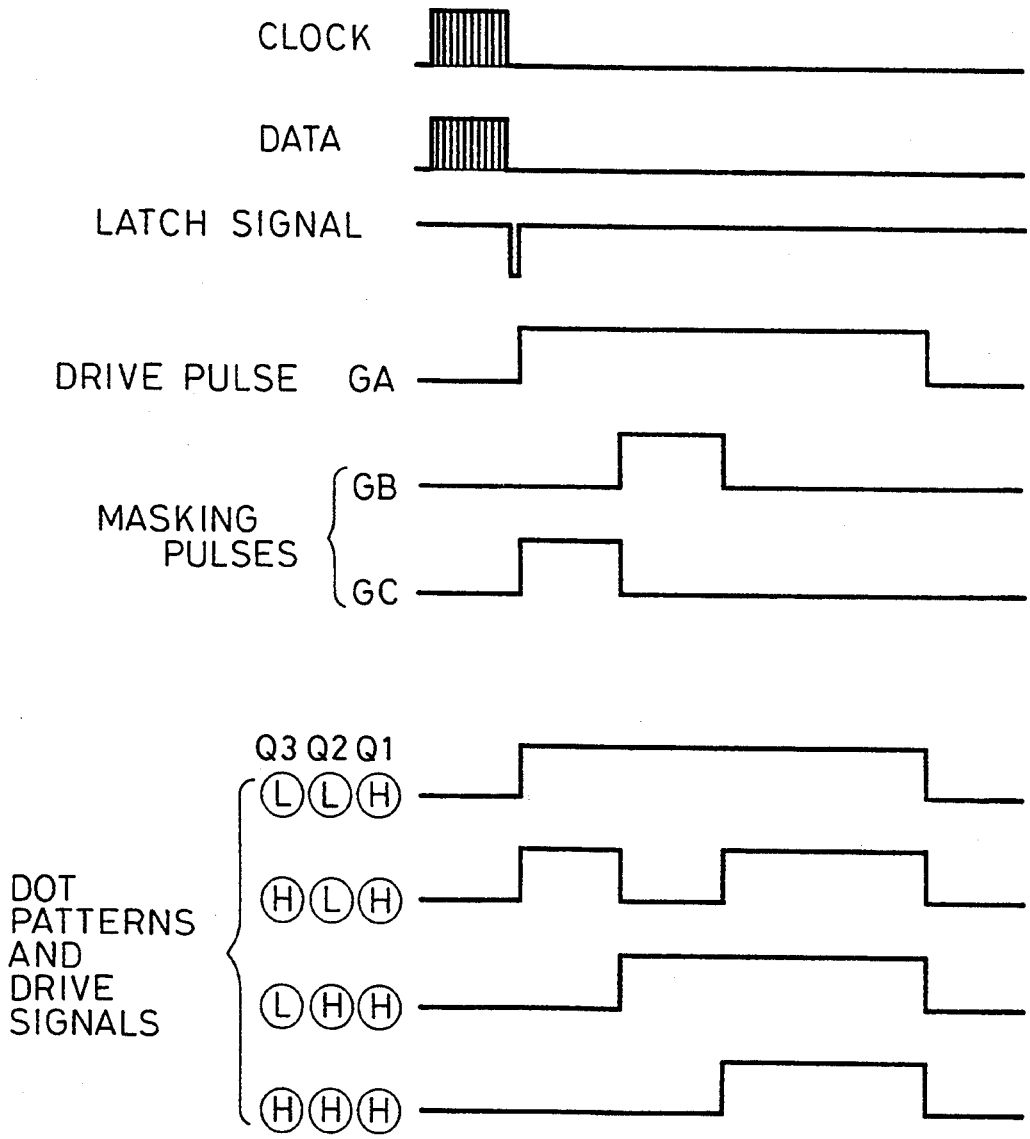
FIG. 6 PRIOR ART
FIG. 6 is a timing diagram illustrating prior-art historical control.

Referring to FIG. 6, the prior-art historical control circuit operates as follows. First the shift register 12 receives a series of clock signals, causing it to input and store one line of dot data. Next a latch signal is input, causing the latch 6 to latch one bit of dot data output by the shift register 12; then the pulse generator 8 generates a drive pulse at GA and masking pulses at GB and GC. The masking pulses GB and GC are of equal length. The masking pulse GC is timed to coincide with an initial interval of the drive pulse CA; the masking pulse GB coincides with an immediately following interval.

If a dot is to be printed, as indicated by active (H) output at Q1, the logic circuit 10 sends a drive signal to the driver circuit 4. The shape and duration of the drive signal depend on the pattern of historical dots. The current pulse fed by the driver circuit 4 to the resistive heating element 2 has the same shape as the drive signal.

If the two preceding dots were not printed, i.e. if Q2 and Q3 are both inactive (L), the drive signal consists of a single pulse equal in duration to the drive pulse GA, as shown for the L-L-H pattern in FIG. 6. If the preceding clot was not printed but the dot before that was printed (the H-L-H pattern), the historical dot signal Q3 Is active, so the drive signal is masked during the Interval while the masking pulse GB Is active. Similarly, in the L-H-H pattern the drive pulse is masked in the interval while GC is active. In the H-H-H pattern the drive signal is masked in both of these intervals.

Referring back FIG. 4, it can be seen that the resistive heating element 2 receives the most current for the L-L-H pattern on level one, which has the lowest point value, and the least current for the H-H-H pattern on level three, which has the highest point value. The two patterns on level two, which have intermediate point values, receive an intermediate amount of current. In this way the historical control circuit compensates for residual heat effects over the two preceding dots.

Due to the nonlinearity of the heating-cooling curve in FIG. 1, however, the historical control illustrated in FIGS. 5 and 6 does not compensate for residual heating with complete accuracy. Specifically, dots printed by the H-L-H, H-H-H, and H-H-H patterns tend to be darker than a dot printed by the L-L-H pattern.

Figure 7:
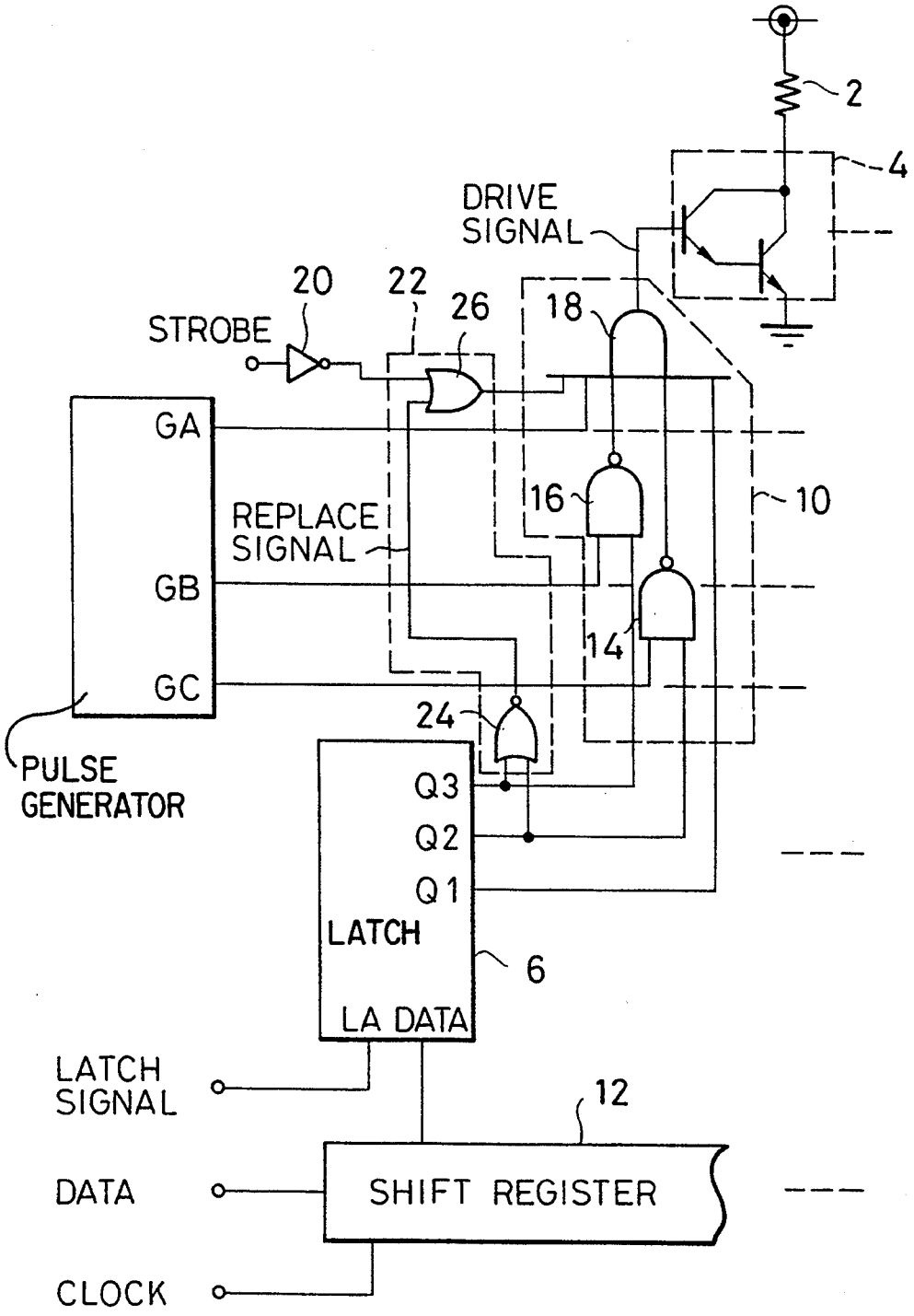
FIG. 7 is a block diagram illustrating a first novel historical control circuit.

FIG. 7 shows a novel historical control circuit that provides additional compensation. The resistive heating element 2, driver circuit 4, latch 6, pulse generator 8, logic circuit 10, and shift register 12 are similar to the elements with the same reference numerals in FIG. 5. The only difference is that the AND gate 18 in the logic circuit 10 has five inputs instead of four.

The novel elements in FIG. 7 are a strobe circuit 20 and a pulse replacing circuit 22. The strobe circuit 20 comprises, for example, an inverting amplifier that inverts a strobe input signal to generate a second drive pulse. The second drive pulse is shorter than the drive pulse GA generated by the pulse generator 8, which will be referred to below as the first drive pulse. The strobe input signal is active low; the second drive pulse output by the strobe circuit 20 is active high.

The pulse replacing circuit 22 comprises a NOR gate 24 and an OR gate 26. The NOR gate 24 receives the historical dot signals from the Q2 and Q3 terminals of the latch 6, and generates a replace signal that is active (high) when Q2 and Q3 are both inactive (low). The OR gate 26 receives this replace signal from the NOR gale 24 and the second drive pulse from the strobe circuit 20 as inputs, and generates an output that is active when either of these inputs is active. The output of the OR gate 26 will also be referred to as the second drive pulse. The effect of the OR gate 26 is to extend the active duration of the second drive pulse by locking the second drive pulse in the active state whenever the replace signal is active.

Figure 8:
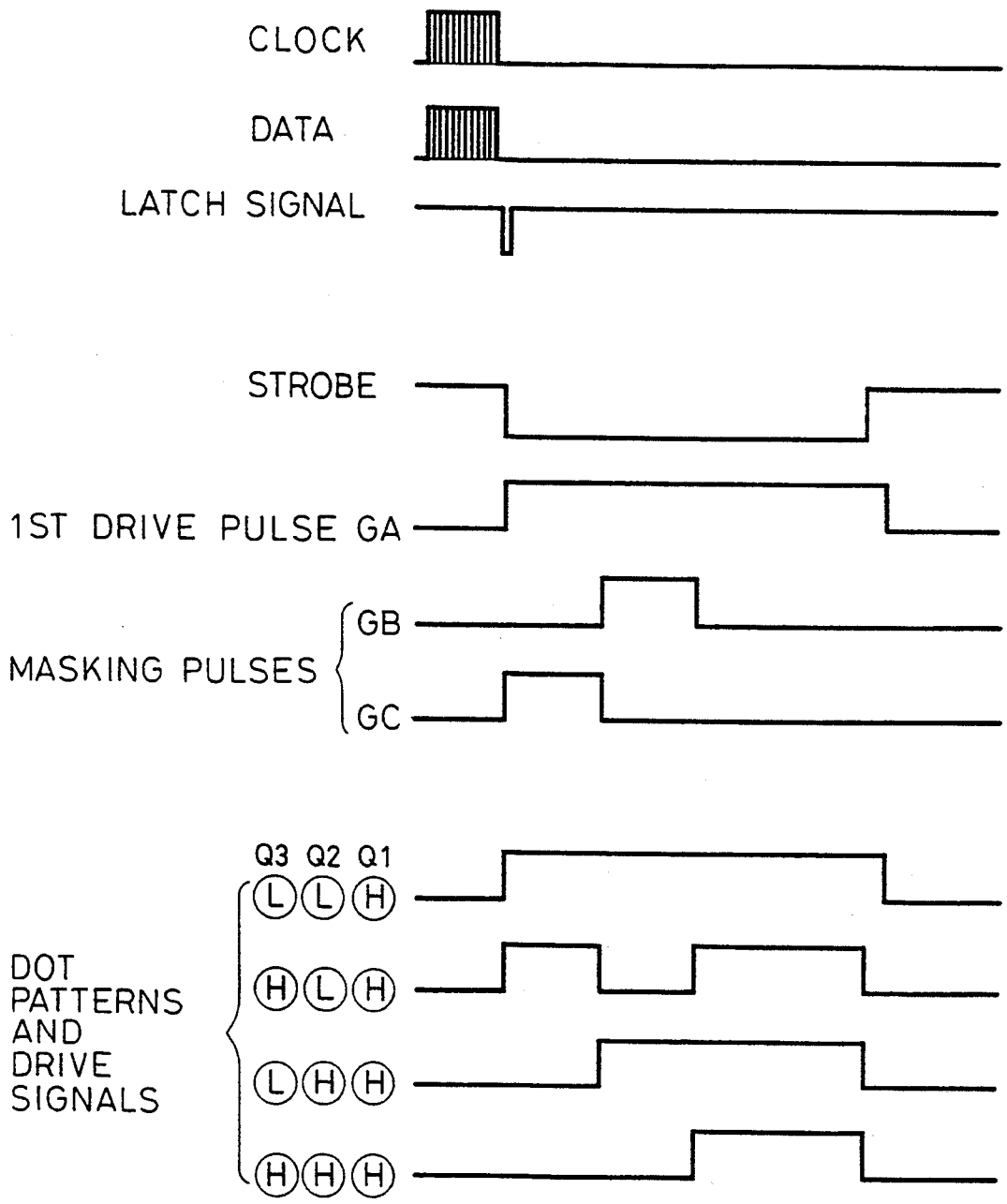
FIG. 8 is a timing diagram illustrating historical control by the first novel historical control circuit.

The operation of this first novel historical control circuit is illustrated in FIG. 8. Clock, data, and latch signals are input as in the prior art. The first drive pulse GA and the masking pulses GB and GC are also as in the prior art. The strobe input is timed to start simultaneously with the first drive pulse When Q2 and Q3 arc both inactive (the L-L-H pattern), the replace signal generated by the NOR gate 24 becomes active, holding the second drive pulse in the high state. The circuit now operates In the same way as in the prior art, producing a drive signal comprising a single pulse equal in duration to the first drive pulse GA.

When either Q2 or Q3 is active (the H-L-H, L-H-H, and H-H-H patterns), the replace signal is inactive, so the second drive pulse produced by the strobe circuit 20 passes unaltered through the OR gate 26. Since the drive signal can be active only when all inputs to the AND gate 18 are active, and since the second drive pulse is shorter than the First drive pulse, the duration of the drive signal is now limited to the duration of the second drive pulse, i.e. to the low duration of the strobe signal. In addition, parts of the drive signal are masked by the masking pulses GB and GC as in the prior art.

The novel historical control circuit in FIG. 7 thus usually generates the drive signal by gating the second drive pulse (the inverted strobe input) by the dot printing signal (Q1), and masking intervals of the second drive pulse defined by the masking pulses (GB and GC) when the corresponding historical dot signals (Q3 and Q2) are active. When the historical dot signals (Q3 and Q2) are both inactive, however, the pulse replacing circuit 22 holds the second drive pulse high, allowing the first drive pulse to replace the second drive pulse and extending the active duration of the drive signal.

FIGS. 9 to 12 illustrate simulated operation of this historical control circuit For *two cases.

Figure 9:
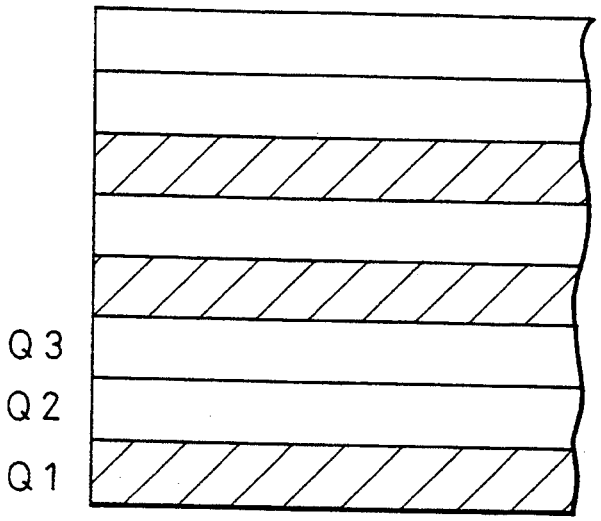
FIG. 9 is drawing illustrating a pattern of dots.
Figure 10:
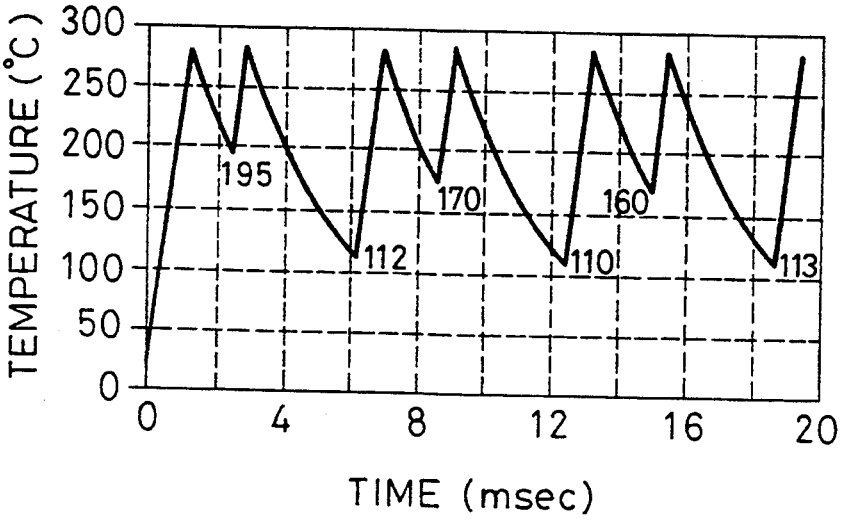
FIG. 10 is graph of the heating curve for the pattern in FIG. 9.

The first case consists of repetitions of the L-H-L-L-H pattern. FIG. 9 illustrates simultaneous printing of this pattern by all dots in a line, showing an interval of eight lines. FIG. 10 illustrates the resulting temperature variations of the heating elements over an interval of sixteen lines, showing temperature on the vertical axis and time on the horizontal axis. Regardless of whether a printed dot is preceded by one or two non-printed dots, the maximum temperature reached is substantially 270° C., resulting in dots of substantially uniform darkness.

Figure 11:
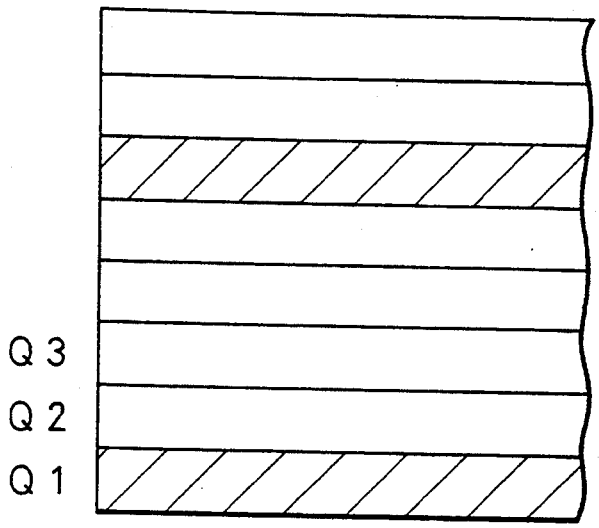
FIG. 11 is drawing illustrating another pattern of dots.
Figure 12:
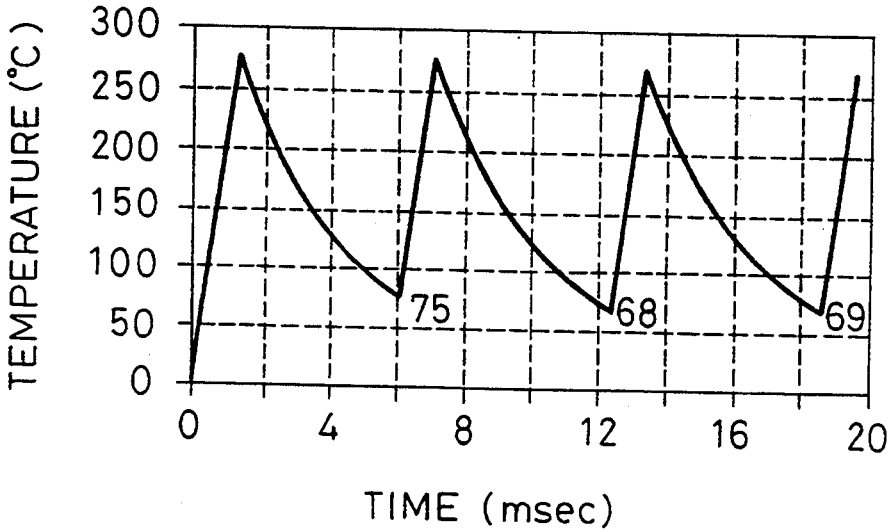
FIG. 12 is graph of the heating curve for the pattern in FIG. 11.

FIGS. 11 and 12 illustrate a similar simulation of repetitions of the L-L-L-L-H pattern. Although each printed dot is now preceded by four non-printed dots, the maximum temperature is again substantially 270° C.

The preceding circuit refined historical control by delaying cutoff of the drive signal when the two preceding dots were not printed. Historical control can also be refined by extension to a larger number of preceding dots: for example, to three preceding dots instead of two, as described next.

Referring to FIG. 13, with three preceding dots there are eight possible historical patterns. The levels and point values of these patterns are defined in the same way as in FIG. 4. A particular problem which the control circuit must overcome is that the L-L-L-H pattern on level one has the same point value (1.0) as the H-L-L-H pattern on level two.

Figure 14:
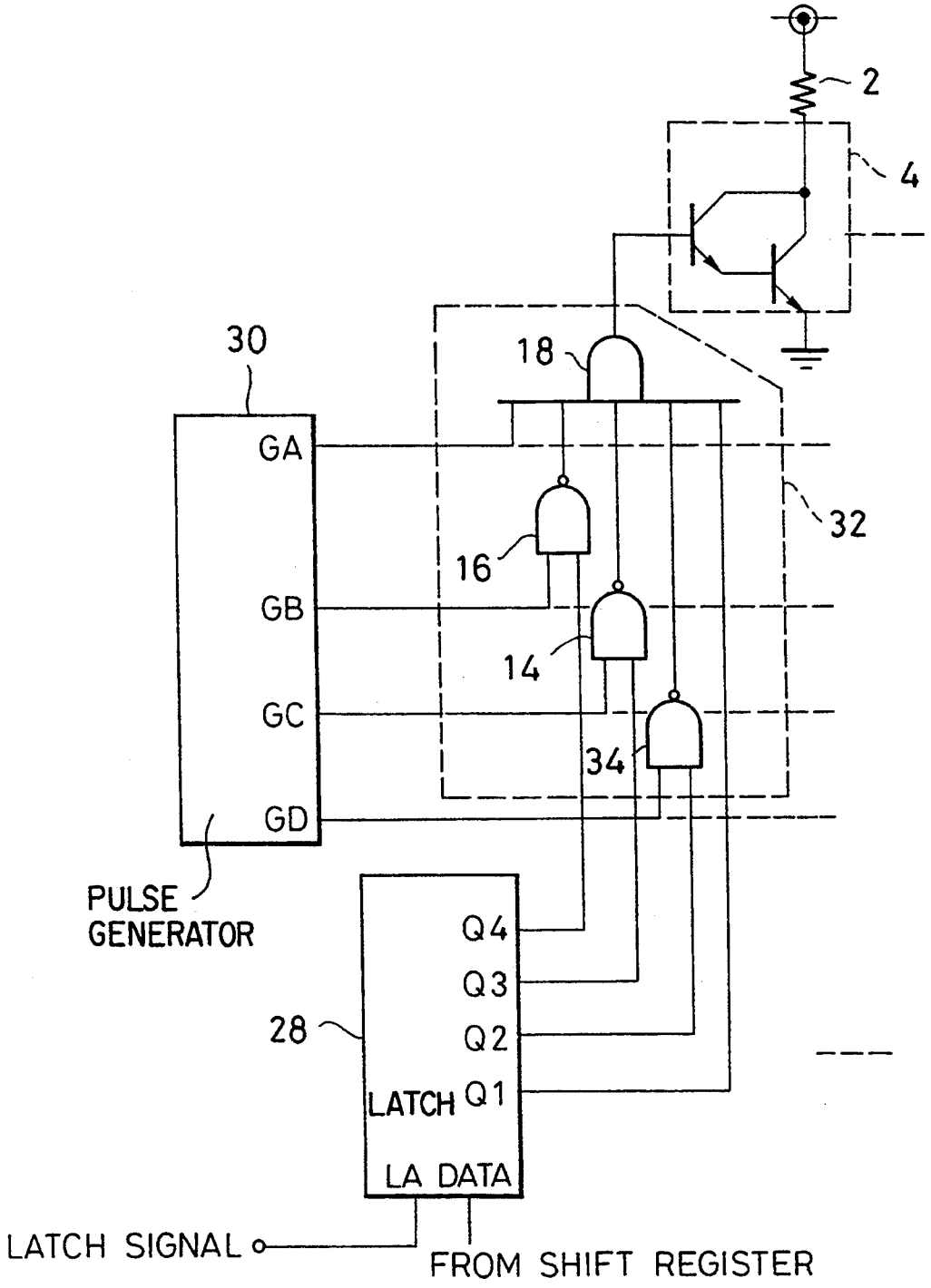
FIG. 14 is a block diagram of a second novel historical control circuit.

FIG. 14 illustrates a second novel historical control circuit that controls drive current according to three historical dots. The resistive heating element 2 and driver circuit 4 are identical to the corresponding elements in the FIGS. 6 and 8. The latch 28 is similar to the latch 6 in FIGS. 6 and 8 but has an additional Q4 terminal for output of a third historical dot signal, indicating whether the third dot preceding the present dot was or was not printed. The pulse generator 30 Is similar to the pulse generator 8 in FIGS. 6 and 8 but has an additional terminal GD for output of a third masking pulse.

The logic circuit 32 is similar to the logic circuit 10 in FIG. 8, but Is interconnected differently to other circuit elements and comprises an additional NAND gate 34. The NAND gate 34 receives the masking pulse from the GD terminal of the pulse generator 30 and the historical dot, signal from the Q2 terminal of the latch 28. The NAND gate 14 receives the masking pulse from the GC terminal of the pulse generator 30 and the historical dot signal from the Q3 terminal of the latch 28. The NAND gate 16 receives the masking pulse from the GB terminal of the pulse generator 30 and the historical dot signal From the Q4 terminal of the latch 28. The AND gate 18 receives the drive pulse from the GA terminal of the pulse generator 30, the dot printing signal from the Q1 terminal of the latch 28, and the outputs of the NAND gates 14, 16, and 34.

Figure 15:
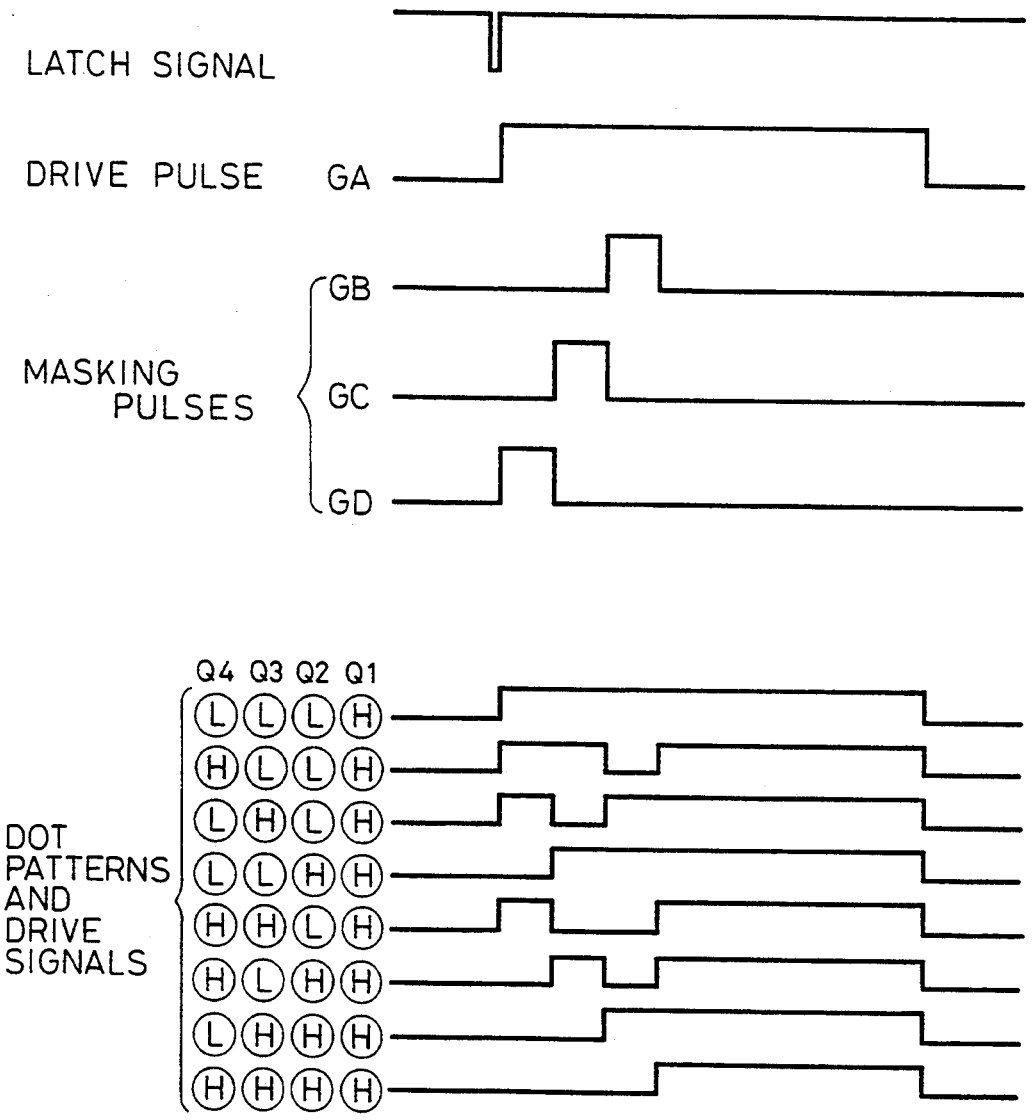
FIG. 15 is a timing diagram illustrating historical control by the second novel historical control circuit.

FIG. 15 illustrates the operation of this historical control circuit. The drive pulse GA is timed to start just after the latch signal. The masking pulse GD starts together with the drive pulse CA, and is consecutively followed by the masking pulses GC and GB.

In the L-L-L-H pattern, all three masking pulses are disabled by the NAND gates 14, 16, and 34, so the drive signal comprises a single pulse having the same duration as the drive pulse GA.

In the H-L-L-H pattern the NAND gate 16 enables the masking pulse from the GB terminal, thus masking an intermediate Interval of the drive signal so that the drive signal is divided into two separate pulses. As was shown in FIG. 1, the most intense heating occurs at the beginning of a pulse. The drive signal for the H-L-L-H pattern includes two such periods of intense heating, so although it feeds less total current than the drive signal for the L-L-L-H pattern, this current Is able to produce substantially the same total amount of heat. This feature overcomes the problem noted in FIG. 13 of patterns with identical point values occurring on different levels.

From FIGS. 13 and 15 it can also be seen that when patterns on the same level have different point values, for patterns with lower point values the drive signal is generally divided into more separate pulses, thus generating more heat. Consider, for example, the three patterns on level two: the drive signals for H-L-L-H and L-H-L-H, which have point values of 1.0 and 1.5, both comprise two separate pulses; the drive signal for L-L-H-H, which has a point value of 2.0, comprises only one pulse. Accordingly, although all three patterns generate the same total current, the L-L-H-H pattern produces less heat than the other two patterns.

A similar condition obtains on level three. The drive signals for H-H-L-H and H-L-H-H, which have point values of 2.5, both comprise two separate pulses. The drive signal for L-H-H-H, which has a point value of 3.0, comprises only one pulse. As on level two, the pattern with the highest point value generates less heat than the other two patterns.

The foregoing inventive concept can be applied to larger numbers of historical dots. FIG. 16 shows the sixteen patterns or four historical dots and lists their levels and point values. In this ease the L-L-L-L-H pattern on level one has the same point value (1.0) as the H-L-L-L-H and L-H-L-L-H patterns on level two, and the L-L-L-H-H pattern on level two has the same point value (2.0) as the H-H-L-L-H, H-L-H-L-H, and H-L-L-H-H patterns on level three.

Figure 17:
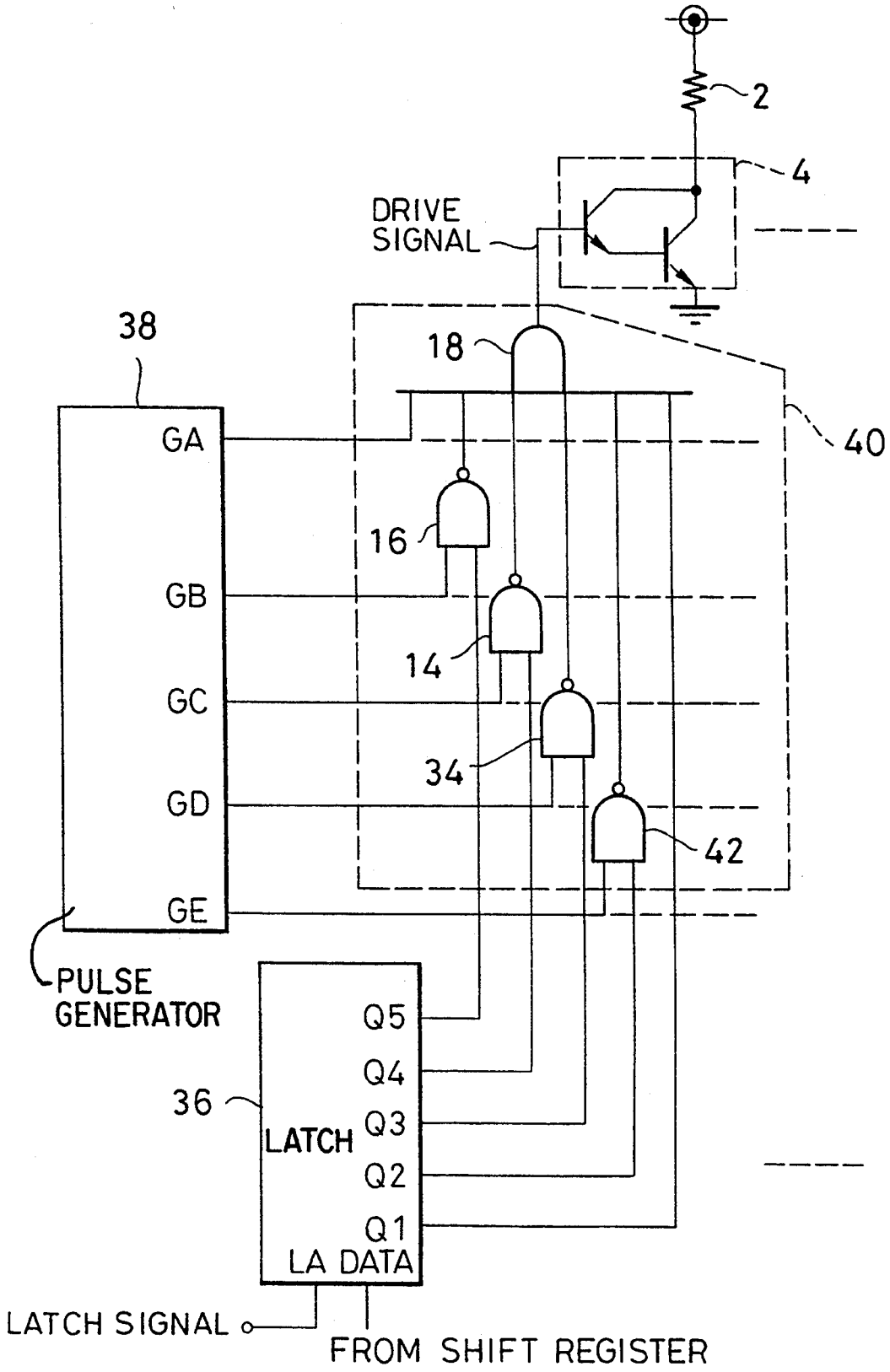
FIG. 17 is a block diagram of a third novel historical control circuit.

FIG. 17 shows a third novel historical control circuit that controls drive current according to four historical dots. The resistive heating element 2 and driver circuit 4 are identical to the corresponding elements in the FIG. 14. The latch 36 is similar to the latch 28 in FIG. 14 but has an additional Q5 terminal for output of a fourth historical dot signal, indicating whether the fourth dot preceding the present dot was or was not printed. The pulse generator 38 is similar to the pulse generator 30 In FIG. 14 but has an additional terminal GE for output of a fourth masking pulse.

The logic circuit 40 is similar to the logic circuit 32 in FIG. 14, but comprises an additional NAND gate 42 that receives the masking pulse from the GE terminal of the pulse generator 38 and the historical dot signal from the Q2 terminal of the latch 28. The NAND gates 34, 14 and 16 respectively input the GD, GC, and GB masking pulses from the pulse generator 38 and the Q3, Q4, and Q5 historical dot signals from the latch 36.

Figure 18:
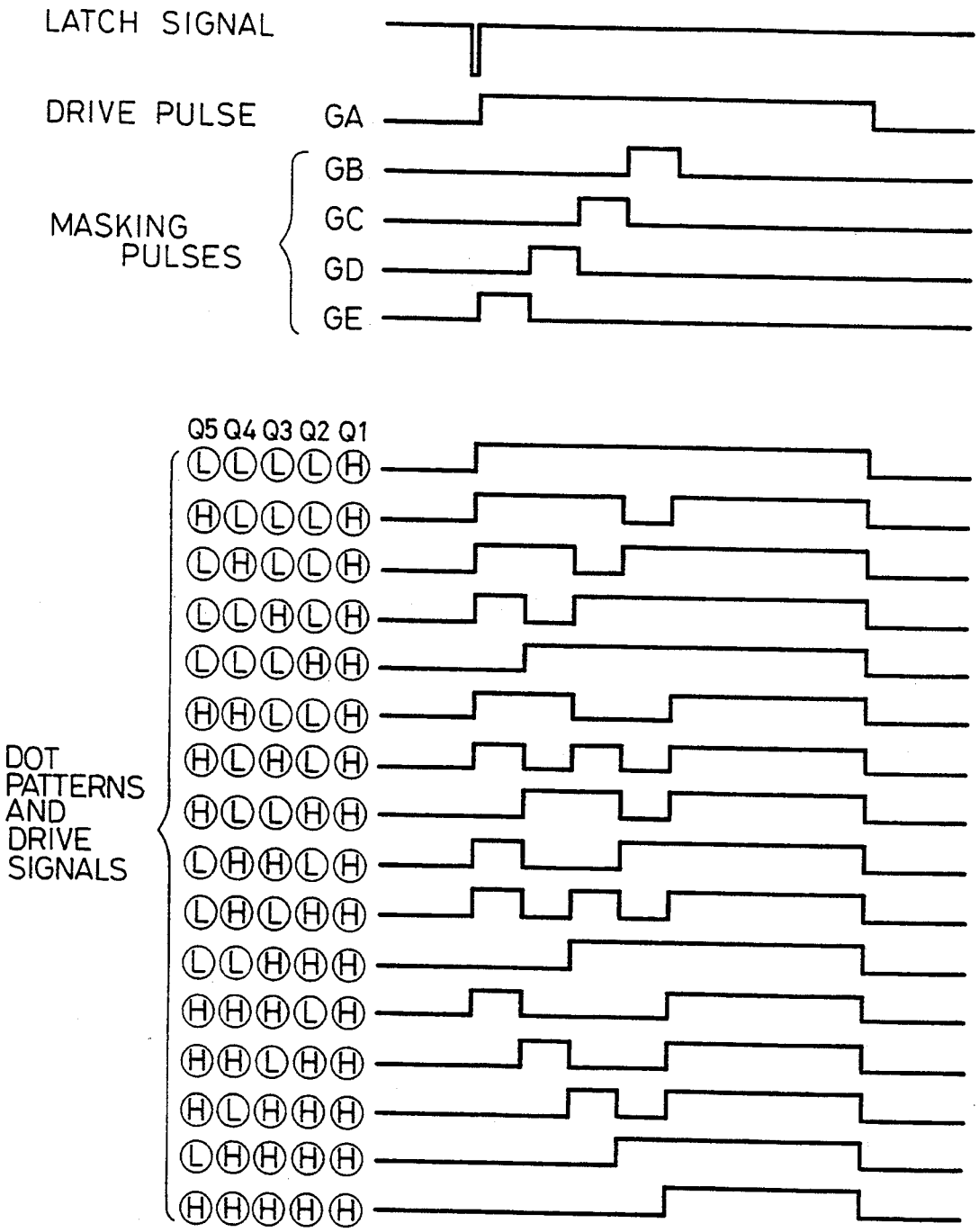
FIG. 18 is a timing diagram illustrating historical control by the third novel historical control circuit.

FIG. 18 illustrates the operation of this historical control circuit. The drive pulse GA is timed to start just after the latch signal. The masking pulse GE starts together with the drive pulse CA, and is consecutively followed by the masking pulses GD, GC, and GB.

In the L-L-L-L-H pattern on level one, all four masking pulses are disabled by the NAND gates 14, 16, 34, and 42, so the drive signal comprises a single pulse having the same duration as the drive pulse GA. In the H-L-L-L-H and L-H-L-L-H patterns on level two, which have the same point value, the drive signal is divided into two separate pulses, providing substantially the same amount of heat as for the L-L-L-L-H pattern but with less total current.

Similarly, the drive signal for the L-L-L-H-H pattern on level two comprises a single pulse. The drive signals for the H-H-L-L-H, H-L-H-L-H, and H-L-L-H-H patterns on level three, which have the same point value, deliver less total current but divide the current into two or three pulses, thus driving the resistive heating element 2 more effectively. Once again, patterns on different levels that have the same point values produce substantially equal amounts of heat.

Among patterns on the same level, this historical control circuit also yields to produce less heat for patterns with higher point values. On level two, for example, the least heat is produced (in a single pulse) by the L-L-L-H-H pattern, which has the highest point value of 2.0. Oil level three, the least heat is produced (again in a single pulse) by the L-L-H-H-H pattern, which has the highest point value of 3.0. On level four, the least heat is produced (yet again in a single pulse) by the L-H-H-H-H pattern, which has the highest point value of 4.0.

Figure 19:
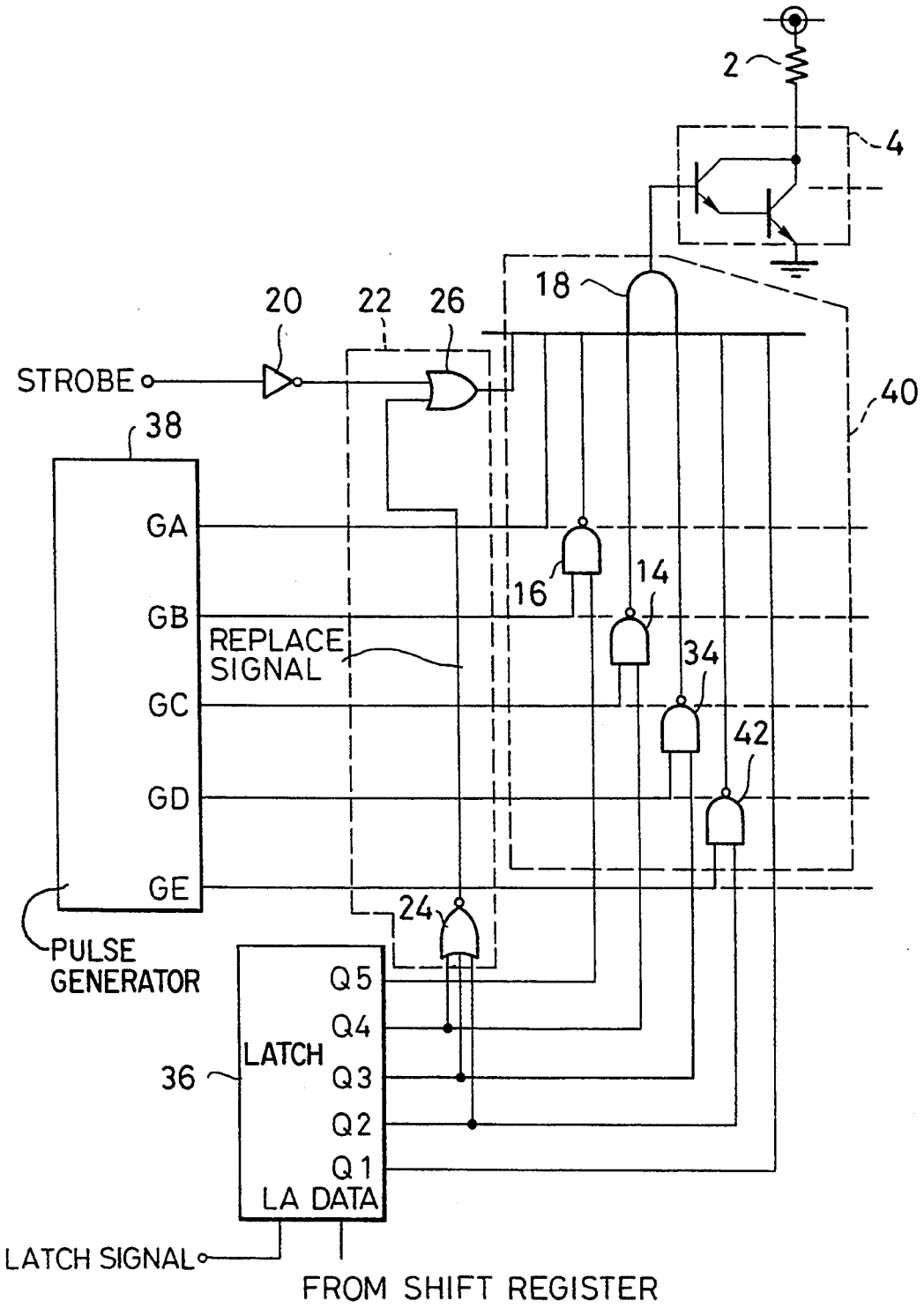
FIG. 19 is a block diagram of a Fourth novel historical control circuit.

Referring to FIG. 19, historical control can be further refined by adding the strobe circuit and pulse replacing circuit of the embodiment of FIG. 7 to the historical control circuit of FIG. 18. The resistive heating element 2, the driver circuit 4, the latch 36, the pulse generator 38, and the logic circuit 40 in FIG. 19 are identical to those in FIG. 18, except that the AND gate 18 now has six inputs instead of five. The strobe circuit 20 and pulse replacing circuit 22 in FIG. 19 are identical to those in FIG. 7 except that the NOR gate 24 has three inputs, connected to the Q2, Q3, and Q4 terminals of the latch 36. The output of the OR gate 26 is the sixth input to the AND gate 18. Operation of this historical is entirely analogous to the operation of the historical control circuits in FIGS. 7 and 18, so a detailed description will be omitted.

The historical control circuit in FIG. 19 replaces the second drive pulse generated by the strobe circuit 20 with the longer first drive pulse from the GA terminal when the three preceding dots were not printed, i.e. when Q2, Q3, and Q4 are all inactive. This is not a restriction, however; by modifying the number of inputs to the NOR gate 24 it is possible to make pulse replacement depend on all four preceding dots not being printed, or on only the two most; recent dots not being printed.

The historical control schemes illustrated in FIGS. 14 to 18 can be modified by masking or unmasking specific intervals for specific patterns. Examples will be shown in FIGS. 20 to 25. The invention is not limited to the specific intervals and specific patterns shown in these drawings; the same concept can be applied to mask or unmask other intervals in other patterns as required.

Figure 20:
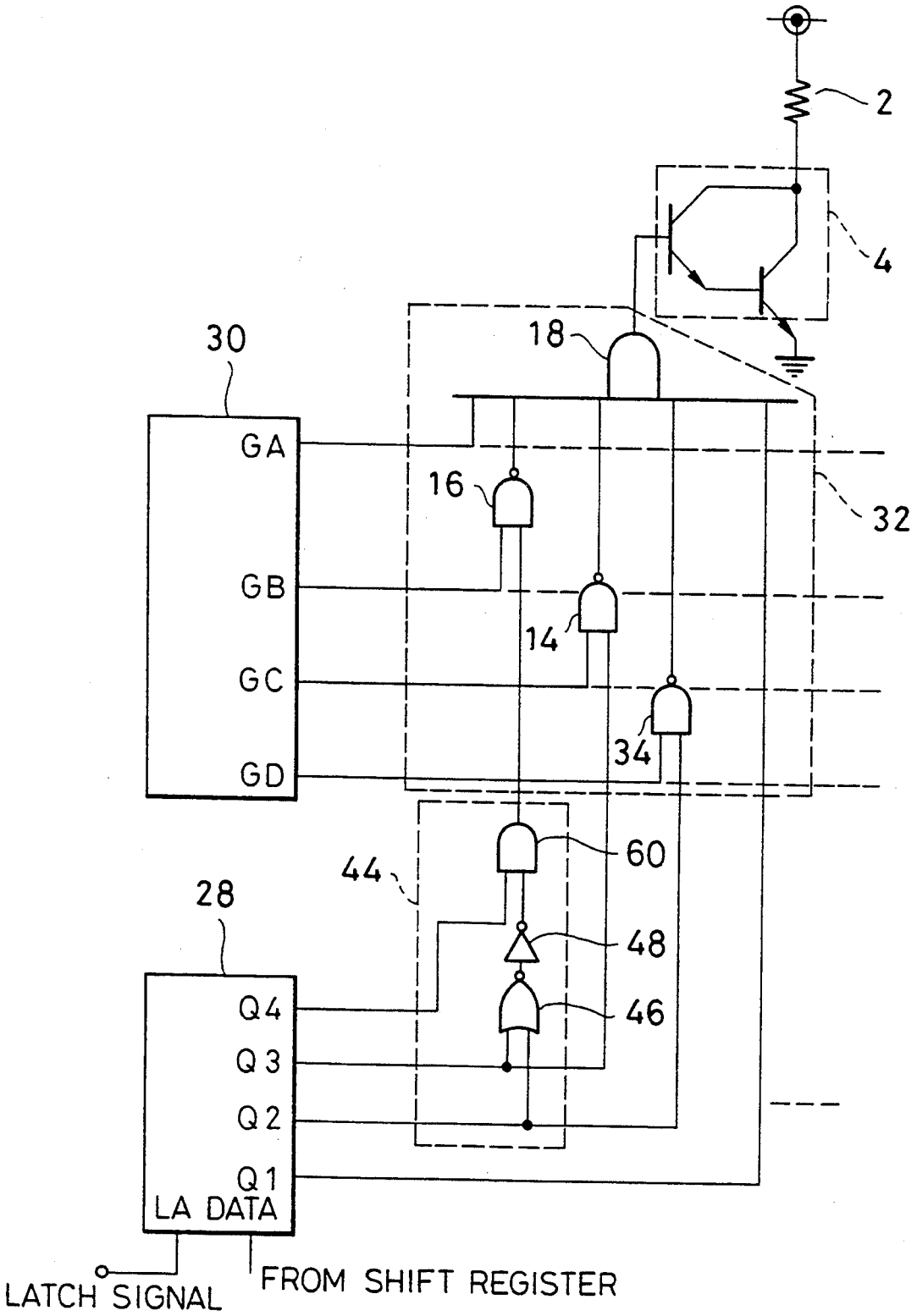
FIG. 20 is a block diagram of a fifth novel historical control circuit.

FIG. 20 illustrates a fifth novel historical control circuit that, like the second novel historical control circuit, controls drive current according to three historical dots. The resistive heating element 2, driver circuit 4, latch 28, pulse generator 30, and logic circuit 32 are identical to the corresponding elements in FIG. 14 and are interconnected in time same way except that the NAND gate 16 is coupled to the latch 28 through an unmasking circuit 44.

The unmasking circuit 44 comprises a NOR gate 46, an inverter 48, and an AND gate 60. The NOR gate 46 is coupled to the Q2 and Q3 terminals of the latch 28 and generates a signal that is inactive when either the Q2 or Q3 historical dot signal is active. The inverter 48 inverts this signal and feeds it to the AND gate 60. The AND gate also receives the Q4 historical dot signal from the latch 28. The output of the AND gate 60 is fed to the NAND gate 16. The function off time unmasking circuit 44 is to disable the Q4 historical dot signal when the Q2 and Q3 historical dot signals are both inactive.

Figure 21:
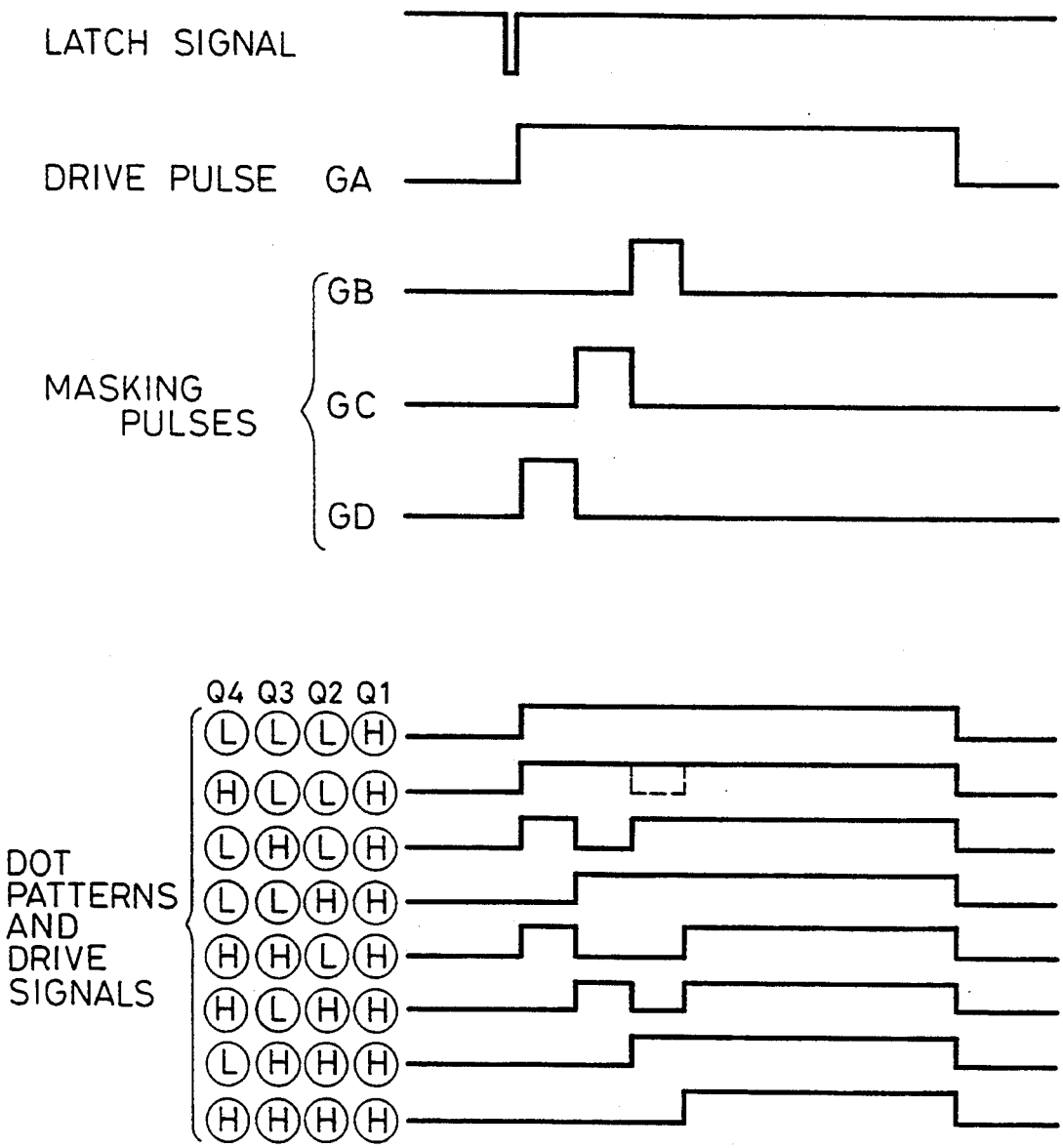
FIG. 21 is a timing diagram illustrating historical control by the fifth novel historical control circuit.

Referring to FIG. 21, the fifth novel historical control circuit operates exactly like the second except in time H-L-L-H pattern. In that pattern, since the Q2 and Q3 historical dot signals are both inactive, the output of the unmasking circuit 44 is inactive, disabling the GB masking pulse. The interval indicated by the dotted line, which was masked in FIG. 15, is therefore unmasked. The drive signal For the H-L-L-H pattern is identical to the drive signal for the L-L-L-H pattern, which is desirable since both patterns have the same point value In FIG. 13.

Figure 22:
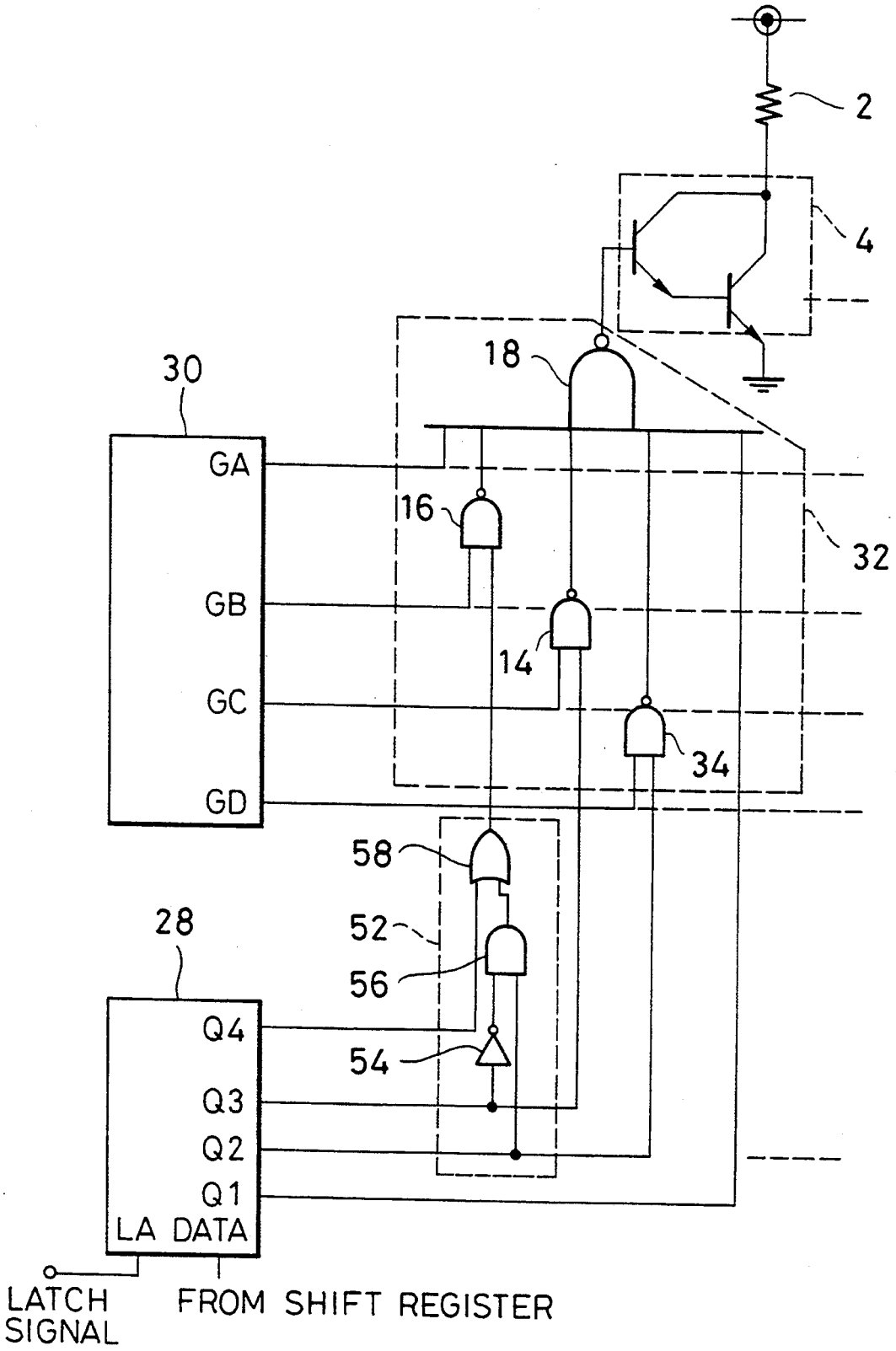
FIG. 22 is a block diagram of a sixth novel historical control circuit.
Figure 23:
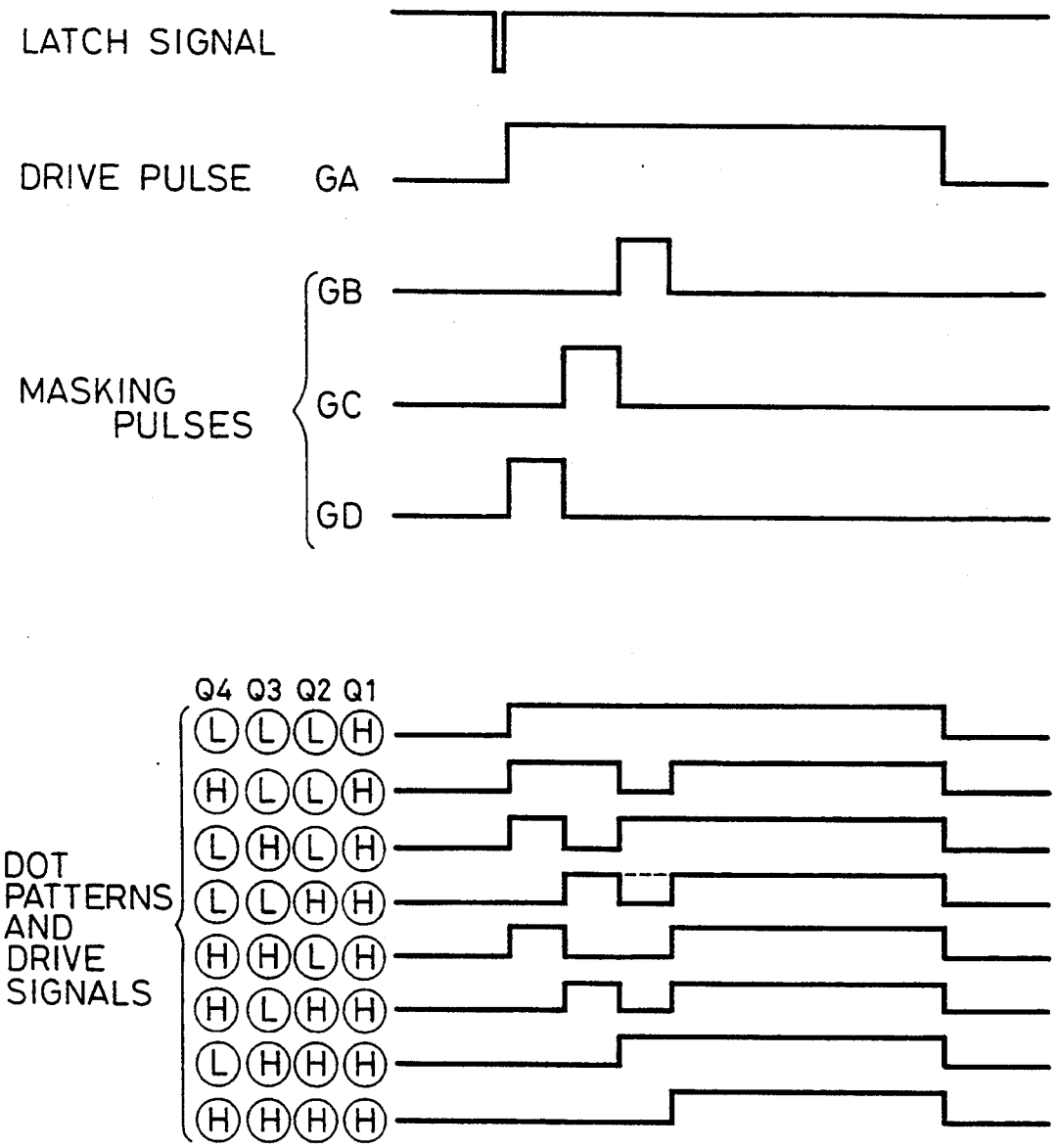
FIG. 23 is a timing diagram illustrating historical control by the sixth novel historical control circuit.

FIG. 22 illustrates a sixth novel historical control circuit that is identical to the fifth except that the unmasking circuit 44 has been replaced by a mask augmenting circuit 52. The mask augmenting circuit 52 comprises an inverter 54, an AND gate 56, and an OR gate 58. The inverter 54 inverts the Q8 historical dot signal. The AND gate 56 ANDs the output of the inverter 54 with the Q2 historical dot signal. The output of the AND gate 56 and the Q4 historical dot signal arc sent to the OR gate 58, and the output of the OR gate 58 is sent to the NAND gate 16. The function of the mask augmenting circuit 52 is to enable the GB masking pulse not only when the Q4 historical dot signal is active, but also when the Q2 historical dot signal is active and the Q8 and Q4 historical dot signals are inactive.

Referring to FIG. 28, the sixth novel historical control circuit operates exactly like the second except in the L-L-H-H pattern. In that pattern, since the Q2 historical dot signal is active and the Q8 and Q4 historical dot signals are inactive, the output of the mask augmenting circuit 52 is active, enabling the GB masking pulse. The interval indicated by the dotted line, which was not masked in FIG. 15, is now masked, reducing the heat produced for the L-L-H-H pattern. This is desirable because the L-L-H-H pattern has the highest point value on level two in FIG. 13.

Figure 24:
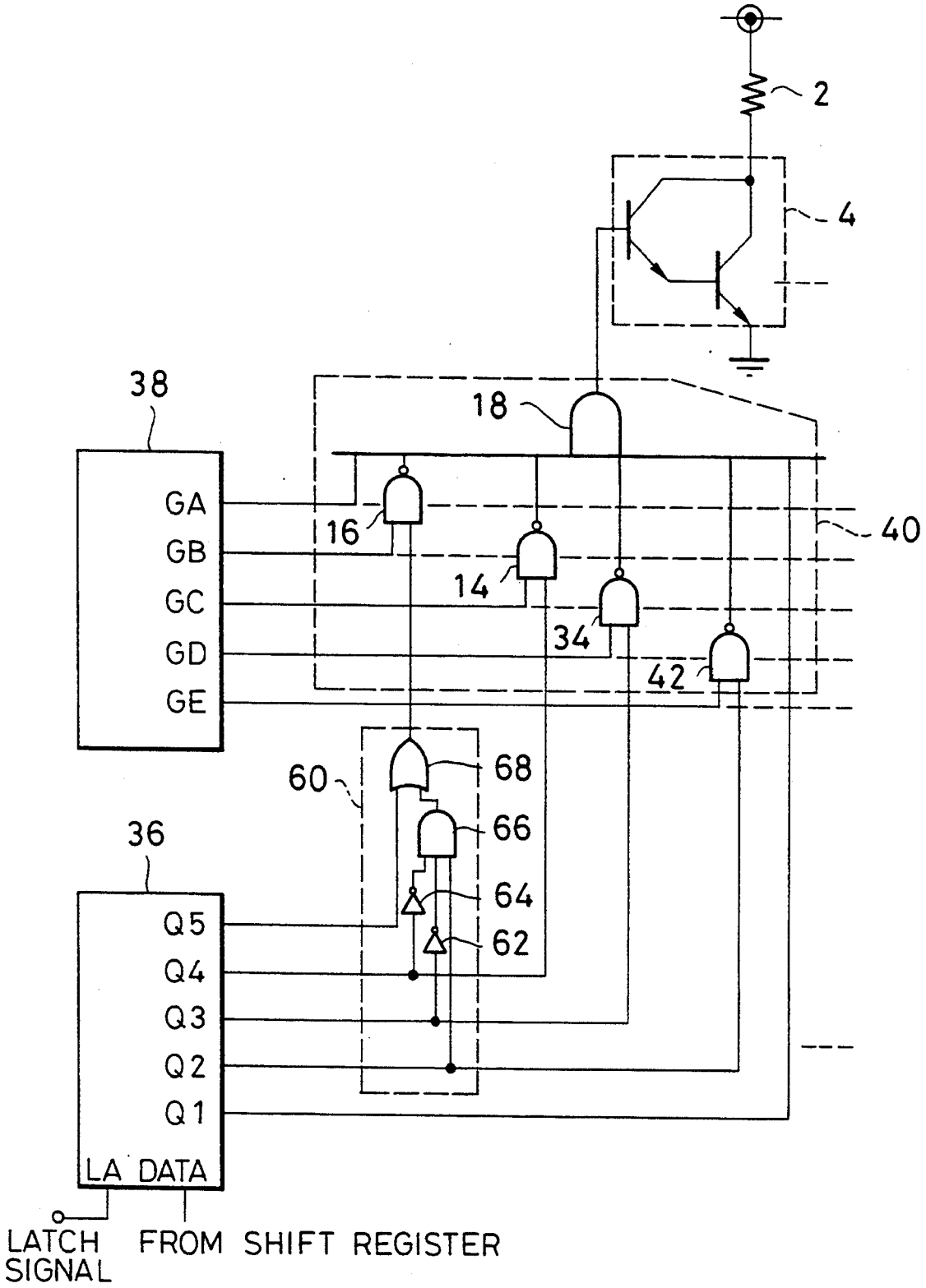
FIG. 24 is a block diagram or a seventh novel historical control circuit.

FIG. 24 illustrates a seventh novel historical control circuit that, like the third novel historical control circuit, controls drive current according to four historical dots. The resistive heating element 2, driver circuit 4, latch 36, pulse generator 38, and logic circuit 40 are identical to the corresponding elements in FIG. 17 and are interconnected in the same way except that the NAND gate 16 Is coupled to the latch 36 through a mask augmenting circuit 60.

The mask augmenting circuit 60 comprises a pair of inverters 62 and 64, a three-input AND gate 66, and an OR gate 68. The inverters 62 and 64 invert the Q3 and Q4 historical dot signals. The AND gate 66 ANDs the outputs of the inverters 62 and 64 with the Q2 historical dot signal. The output of the AND gate 66 and the Q5 historical dot signal are sent to the OR gate 68, and the output of the OR gate 68 is sent to the NAND gate 16. The function of the mask augmenting circuit 60 is to enable the GB masking pulse not only when the Q5 historical dot signal is active, but also when the Q2 historical dot signal Is active and the Q3, Q4, and Q5 historical dot signals are inactive.

Figure 25:
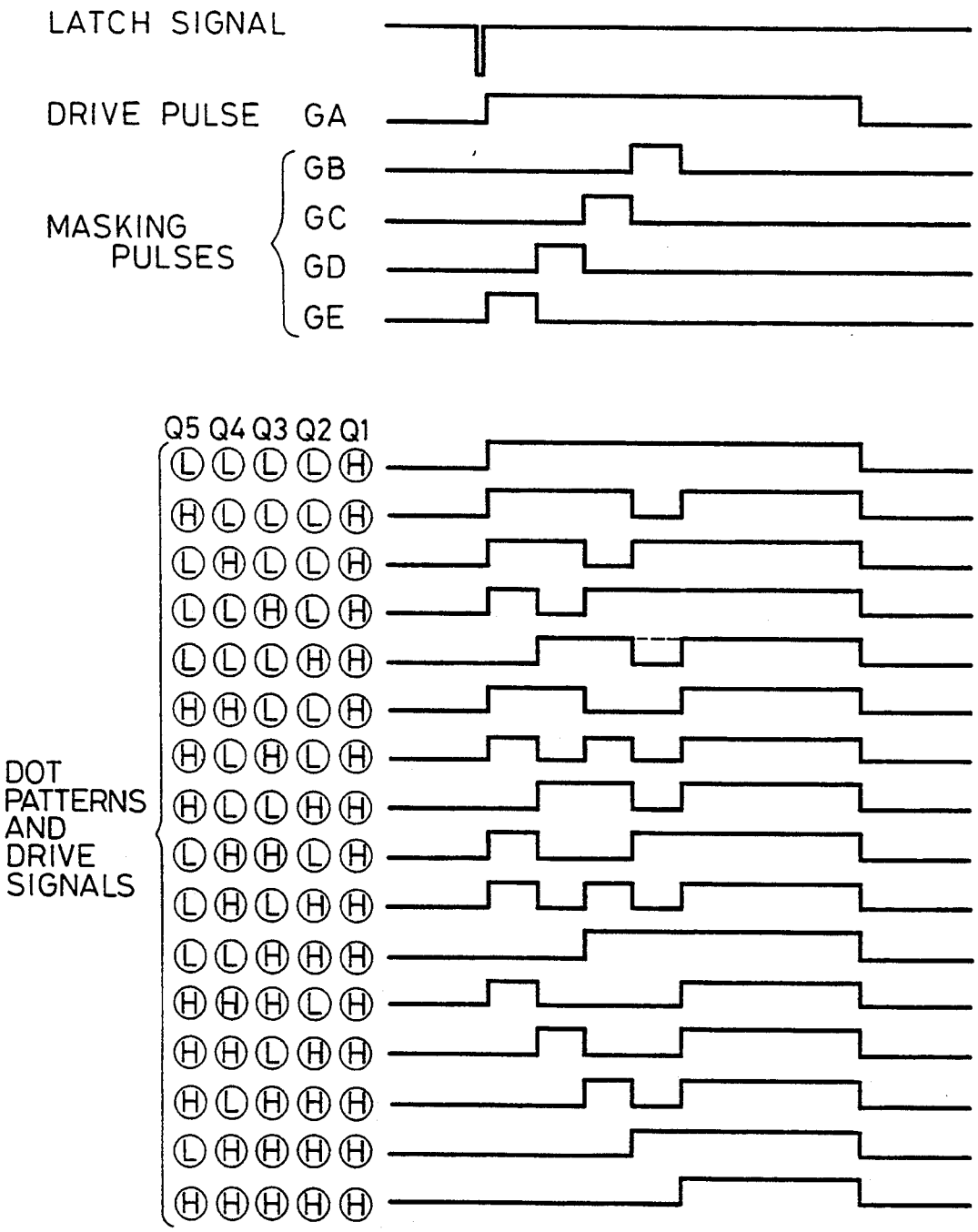
FIG. 25 is a timing diagram illustrating historical control by the seventh novel historical control circuit.

Referring to FIG. 25, the seventh novel historical control circuit operates exactly like the third except in the L-L-L-H-H pattern in that pattern, since the Q2 historical dot signal is active while Q3, Q4, and Q5 are inactive, the output of the mask augmenting circuit 60 is active, enabling the GB masking pulse. The interval indicated by the dotted line, which was not masked in FIG. 18, is now masked, reducing the heat produced for the L-L-L-H-H pattern. This is desirable because the L-L-L-H-H pattern has the highest point value on level two in FIG. 16.

In the historical control circuits described above the masking pulses output at terminals GB to GE were all of the same length, but the inventive concepts can also be combined with a scheme using masking pulses of different lengths.

The drive or masking pulses need not themselves be single pulses; they may comprise a series of shorter pulses. In tills case the drive signal For the pattern with the highest point value on each level will comprise a number of pulses, while the drive signals for other patterns will generally comprise a larger number of pulses.

The control schemes of FIGS. 1S, 18, 21, 23, and 25 can be extended to five preceding dots or even more. In any of the control schemes described above, the signal logic can be changed from active high to active low with appropriate modifications to the gates in the logic circuit, pulse replacing circuit, unmasking circuit, and mask augmenting circuit. The unmasking circuit or mask augmenting circuit can moreover be structured as a retriggering circuit or an analog switching circuit instead of with logic gates. Various other modifications, as will be apparent to those skilled in the art can also be made without departing from the spirit and scope of the Invention, which should be determined solely from the appended claims.

What is claimed is:

1. A method of controlling current fed to a resistive heating element in a thermal printer for printing a dot on a printing medium according to a history of printing of a predetermined series of preceding dots in consecutive dot positions on said printing medium by that resistive heating element, comprising the steps of:

(a) feeding a first drive pulse to said heating element to print a dot when a certain number of preceding dots of said series were not printed;

(b) feeding a second drive pulse to said heating element shorter than said first drive pulse to print a dot when at least one of said certain number of preceding dots was printed; and (c) masking certain intervals within said second drive pulse as a function of patterns of dots among said certain number of preceding dots which were printed.

2. The method of claim 1, wherein said certain number is two.

3. The method of claim 1, wherein said certain number is three.

4. The method of claim 1, wherein said Intervals are consecutive, non-overlapping, and of equal length.

5. An historical control circuit for a thermal printer, comprising:

a resistive heating element;

driver means coupled to feed current to said resistive heating element responsive to a drive signal for causing said resistive heating element to print a dot on a printing medium;

latch means for generating a dot printing signal and at least two historical dot signals, indicating printing of a dot by said resistive heating element in at least three consecutive positions on said printing medium;

pulse generating means for generating a first drive pulse and at least two masking pulses each corresponding to a respective historical dot signal;

strobe means for generating a second drive pulse, shorter than said first drive pulse;

logic means for feeding said second drive pulse to said driver means as said drive signal in response to said dot printing signal and at least one historical dot signal, and for masking certain intervals within said second drive pulse defined by said masking pulses in combination with corresponding historical dot signals; and pulse replacing means coupled to replace said second drive pulse with said first drive pulse as said drive signal when a certain number of said historical dot signals are all inactive.

6. The circuit of claim 5, wherein said latch means generates two historical dot signals.

7. The circuit of claim 6, wherein said certain number is two.

8. The circuit of claim 5, wherein said latch means generates four historical dot signals.

9. The circuit of claim 8, wherein said certain number is three.

10. The circuit of claim 5, wherein said logic means comprises:

at least two first gate means for gating said masking pulses with said historical dot signals; and second gate means for receiving as inputs said dot printing signal, said first drive pulse, said second drive pulse, and outputs of said first gate means and activating said drive signal when said inputs are all active.

11. The circuit of claim 10, wherein said first gate means are NAND gates and said second gate means is an AND gate.

12. The circuit of claim 10, wherein said pulse replacing means comprises:

third gate means coupled to receive said certain number of most recent historical dot signals and generate a replace signal that is active when said certain number of historical dot signals are all inactive; and fourth gate means coupled to make said second drive pulse active whenever said replace signal is active.

13. The circuit of claim 12, wherein said third gate means is a NOR gate and said fourth gate means is an OR gate.

* * * * *

UNITED STATES PATENT AND TRADEMARK OFFICE

CERTIFICATE OF CORRECTION

PATENT NO. : 5,377,159 Page 1 of 2

DATED : December 27, 1994

INVENTOR(S) : Takafumi Endo

It is certified that error appears in the above-indentified patent and that said Letters Patent is hereby corrected as shown below:

Col. 1, line 40, "thee" should be —the— Col. 2, line 16, "Is" should be -- is --; Col. 2, line 19, "Information" should be -- information --; Col. 2, line 21, "Illustrating" should be -- illustrating --; Col. 3, line 3, "onemil-" should be -- one-mil- --; Col. 3, line 13, "Form" should be -- form --; Col. 3, line 15, the formula should be -- $\Delta T=Pd\cdot Rth\cdot\{1-\exp(-t/\tau)\}$ --; Col. 3, line 23, after "temperature" insert a comma; Col. 3, line 29, "ti (Itigh)" should be -- H (High) --; Col. 3, line 41, "biglief" should be -- higher --; Col. 3, line 47, delete "("; Col. 4, line 13, "CA" should be -- GA --; Col. 4, line 16, "arc" should be -- are --; Col. 4, line 32, "Inactive" should be -- inactive --; Col. 4, line 36, "dater" should be -- data --; Col. 4, line 49, "CA" should be -- GA --; Col. 4, line 62, "clot" should be -- dot --; Col. 4, line 63, "Is" should be -- is --;

UNITED STATES PATENT AND TRADEMARK OFFICE

CERTIFICATE OF CORRECTION

PATENT NO. :5,377,159

DATED :December 27, 1994

INVENTOR(S) :Takafumi Endo

It is certified that error appears in the above-indentified patent and that said Letters Patent is hereby corrected as shown below:

Col. 4, line 64, "Interval" should be -- interval --; Col. 5, line 38, "gale" should be -- gate --; Col. 5, line 52, after "pulse" insert —GA.— Col. 5, line 53, "arc" should be -- are --; Col. 5, line 56, "In" should be -- in --; Col. 5, line 66, "First" should be -- first --; Col. 6, line 15, "For" should be -- for --; Col. 6, line 15, delete "*"; Col. 6, line 52, "Is" should be -- is --; Col. 6, line 66, "From" should be -- from -- ; Col. 7, line 20, "Is" should be -- is --; Col. 7, line 61, "In" should be -- in --; Col. 8, line 32, "Oil" should be -- On --; Col. 9, line 20, "off time" should be -- of the --; Col. 9, line 32, "In" should be -- in --; Col. 9, line 39, "Q8" should be -- Q3 --; Col. 9, line 42, "arc" should be -- are --; Col. 9, line 49, "28" should be -- 23 --; Col. 9, line 52, "Q8" should be -- Q3 --; Col. 9, line 67, "Is" should be -- is --; Col. 10, line 12, "Is" should be -- is --; Col. 10, line 16, "pattern in" should be -- pattern. In --; Col 10, line 32, "tills" should be —this— Col. 10, line 32, "For" should be -- for --; Col. 10, line 37, "1S" should be -- 15 --; Col. 10, line 47, after "art" insert a comma; Col. 10, line 49, "Invention" should be -- invention --; Col. 11, line 5 (claim 4), "Intervals" should be -- intervals --.

Signed and Sealed this

Fifteenth Day of August, 1995

*Attest:*

*Attesting Officer*

BRUCE LEHMAN

*Commissioner of Patents and Trademarks*